US007497603B2

(12) United States Patent
Malkanov

(10) Patent No.: US 7,497,603 B2
(45) Date of Patent: Mar. 3, 2009

(54) LIGHTING UNIT WITH INTEGRATED DEVICE FOR ATTACHING SOFTBOXES OF VARIOUS SIZES

(75) Inventor: Todor Angelov Malkanov, Sofia-Reduta (BG)

(73) Assignee: Dedo Weigert Film GmbH, Munich (DE)

( * ) Notice: Subject to any disclaimer, the term of this patent is extended or adjusted under 35 U.S.C. 154(b) by 133 days.

(21) Appl. No.: 11/400,214

(22) Filed: Apr. 10, 2006

(65) Prior Publication Data

US 2006/0227527 A1 Oct. 12, 2006

(30) Foreign Application Priority Data

Apr. 11, 2005 (DE) ..... 20 2005 005 718 U

(51) Int. Cl.
*F21V 11/00* (2006.01)

(52) U.S. Cl. ..... 362/355; 362/16; 362/352

(58) Field of Classification Search ..... 362/352, 362/16, 3, 18, 353, 355, 356, 357; 248/163.1, 248/163.2, 164–173, 436, 439; 396/428
See application file for complete search history.

(56) References Cited

U.S. PATENT DOCUMENTS 3,294,962 A * 12/1966 Hilzen ..... 362/13
5,803,585 A * 9/1998 Littman et al. ..... 362/147
5,865,406 A * 2/1999 Teeple ..... 248/163.1
6,176,598 B1 * 1/2001 Seligman et al. ..... 362/352
6,709,121 B1 * 3/2004 Lowe et al. ..... 362/18
6,808,295 B2 * 10/2004 Waltz et al. ..... 362/353
7,063,428 B2 * 6/2006 Lowe ..... 362/18
7,246,925 B2 * 7/2007 Waltz et al. ..... 362/355

* cited by examiner

*Primary Examiner*—Sandra L. O'Shea
*Assistant Examiner*—Gunyoung T. Lee
(74) *Attorney, Agent, or Firm*—Collard & Roe, P.C.

(57) ABSTRACT

A lighting unit includes a device for an attachment of a softbox, wherein the device for the attachment of the softbox has at least three hollow cylinders serving as receptacles of one softbox rod, wherein each of the at least three hollow cylinders is slidable in a direction of a longitudinal axis of the respective hollow cylinder, each of the at least three hollow cylinders acting in concert with a locking device to be manually settable in a locked position and an adjustable position without additional tools, wherein in the locking position, the locking device locks the hollow cylinder into at least one position, and in the adjustable position, the hollow cylinder is slidbale in the direction of the longitudinal axis to a different position.

10 Claims, 11 Drawing Sheets

LIGHTING UNIT WITH INTEGRATED DEVICE FOR ATTACHING SOFTBOXES OF VARIOUS SIZES

CROSS-REFERENCE TO RELATED APPLICATIONS

This Nonprovisional Application claims priority under 35 U.S.C. §119(a) on Utility Model Application No. DE 20 2005005718.5 filed in Germany on Apr. 11, 2005, the entire contents of which are hereby incorporated by reference.

BACKGROUND OF THE INVENTION

1. Field of the Invention

The present invention is directed to lighting units, or spotlights (these two terms are synonymously used in the text below).

2. Discussion of the Related Art

It is known from state-of-the-art technology that for various application purposes, so-called softboxes are attached to spotlights, or lighting units, to soften the light emitting from these lighting units. This is frequently necessary in film, television, or photographic shootings, for example.

It is known from conventional technology to attach a so-called speed ring to the lamp head for this purpose. The speed ring has four bores. In these four bores, four rods—the softbox rods—are inserted, which are under mechanical tension and will have a cambered shape after insertion. Over these four rods, a textile cover is stretched. The textile cover and the rods, in combination, form the soft box.

Softboxes are offered by various companies for a variety of spotlights. For these various spotlights, in turn, there are different sizes of front lenses and retaining claws, to which the front accessories are attached. These retaining claws, depending on their diameter, accommodate different speed rings of various diameters, which then require specific softboxes with a rod length and construction that will fit the respective diameters of the speed rings.

The disadvantage of this diversity in conventional technology is that it always requires three matching parts: the softbox, the speed ring, and the lighting unit. This diminishes the interchangeability of the individual parts. For example, if a lighting unit is replaced with a new lighting unit of a somewhat different design, the speed ring that was suitable for the first lighting unit normally cannot be used for the new lighting unit due to mechanical compatibility problems. Thus, a new speed ring has to be obtained at a cost that frequently equals the cost of the lighting unit itself. Furthermore, it can happen that the original, still perfectly usable softbox does not fit the new speed ring—again due to mechanical compatibility problems—thus also necessitating the acquisition of a new softbox.

As a result of these common compatibility problems with conventional technology, a wide variety of diverse accessories of various sizes have to be kept on hand in order to be prepared for all eventualities, or still usable material has to be discarded prematurely. In any case, the diversity, and the compatibility problems associated with it, incur considerable financial expenditures for the users of softbox-lighting-combinations.

A very few conventional speed rings are known, which have slidable retaining arms that allow the mounting of softboxes of various sizes. However, these conventionally known speed rings with slidable retaining arms are extremely difficult to use. The adjustment and locking in place of the retaining arms can only be carried out with great difficulty. The retaining arms have to be loosened with tools, have to be removed completely from the speed ring, and thereafter to be reinserted in a cumbersome way and fastened with tools.

SUMMARY OF THE INVENTION

It is therefore the object of the present invention to provide a lighting unit, which is suitable for use with softboxes of various sizes and is easy to use, and which reduces the above-described compatibility problems.

This objective is achieved with a lighting unit as provided in the present invention.

One of the features of the lighting unit of this invention is the integrated device for the attachment of the softbox. This eliminates the need for a separate speed ring, which singularly reduces the conventional compatibility problems considerably. It is substantially cheaper to provide the lighting unit with an integrated device for the attachment of the softbox than it is to produce and market the lighting unit and the speed ring separately, as has been the norm. Moreover, the adjustable hollow cylinders used as retaining arms for softbox rods make it possible to mount softboxes of various sizes to the lighting unit of the present invention. It can be done by sliding the hollow cylinders in or out to the required length, and then locking them into position. Due to the special locking device, no tools are needed for the adjusting procedure. The position adjustment can be done quickly and in an uncomplicated manner. A user of the lighting unit of the present invention can mount softboxes that are already on hand to the lighting unit of the present invention, without having to expect compatibility problems and without having to invest in speed rings.

One of the advantages of the embodiment of the lighting unit of the present invention is the ability to unfold the tripod arm rearwards to allow a tilting of the softbox on a tripod without the need of a substantial overall increase in the packing size of the lighting unit.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE ILLUSTRATED EMBODIMENTS

A beneficial and preferred embodiment of the lighting unit of the present invention is described below with reference to FIGS. 1-11.

Figure 1:
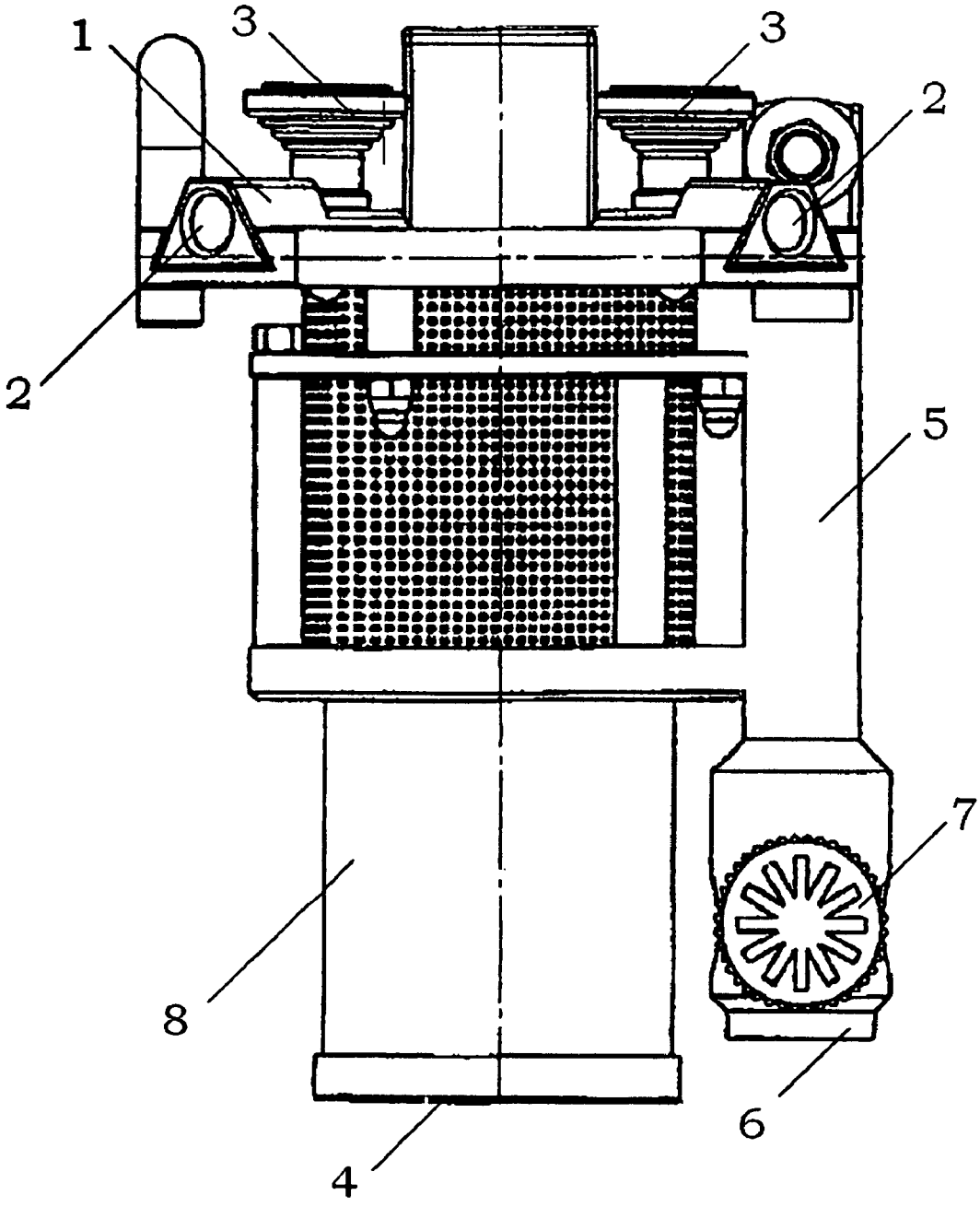
FIGS. 1-5 illustrate a lighting unit in accordance with one embodiment of the present invention in five different views.
Figure 2:
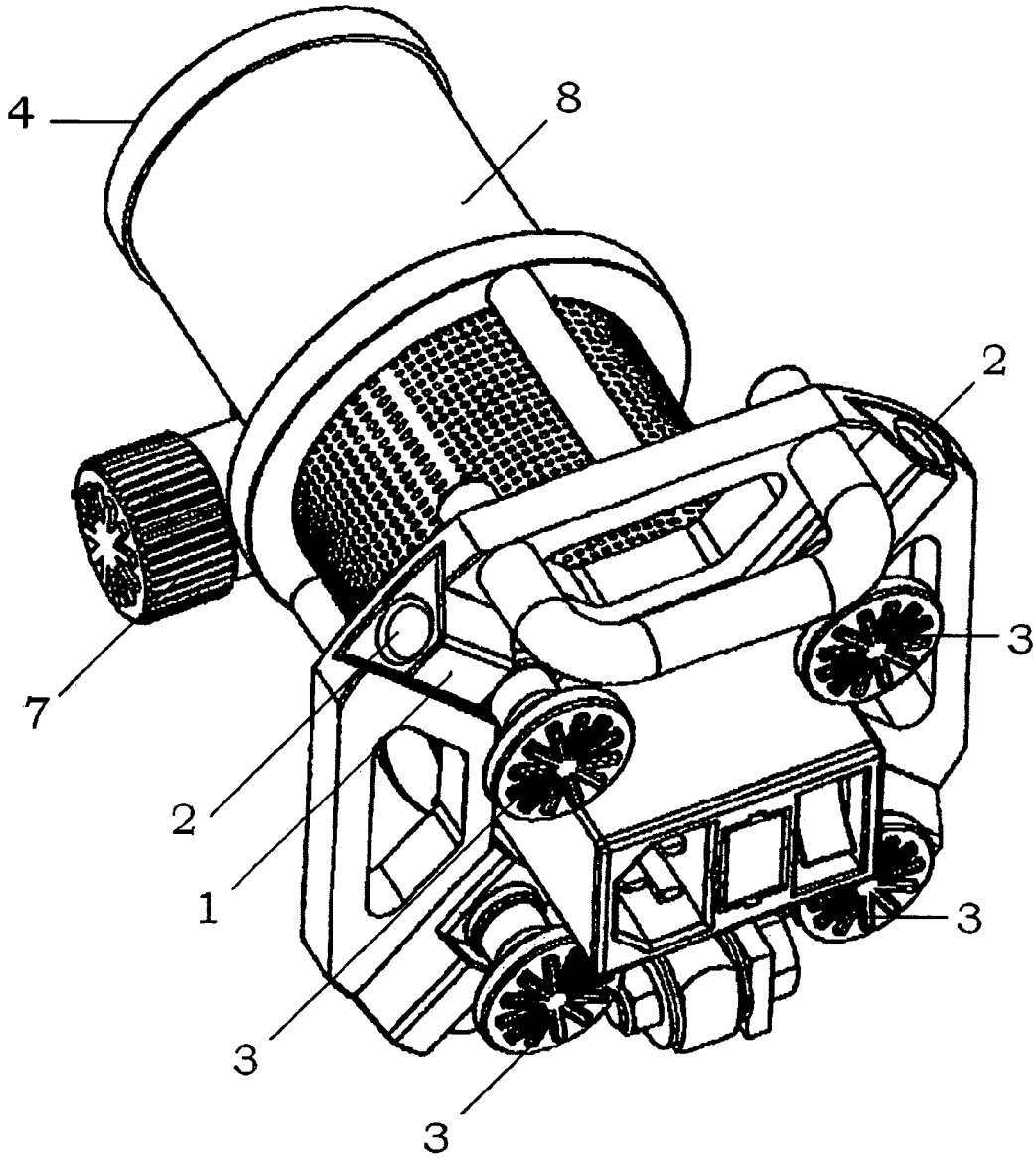
Figure 3:
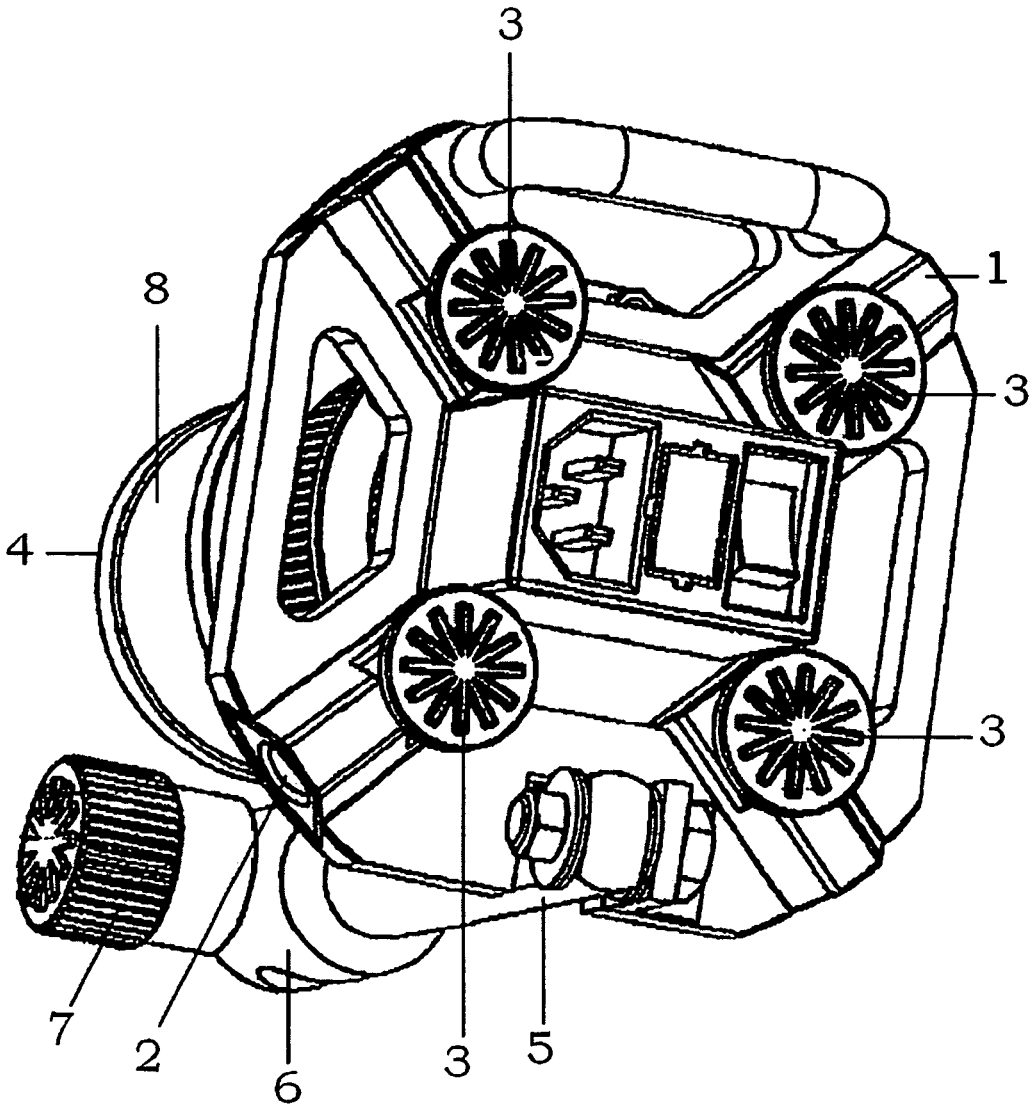
Figure 4:
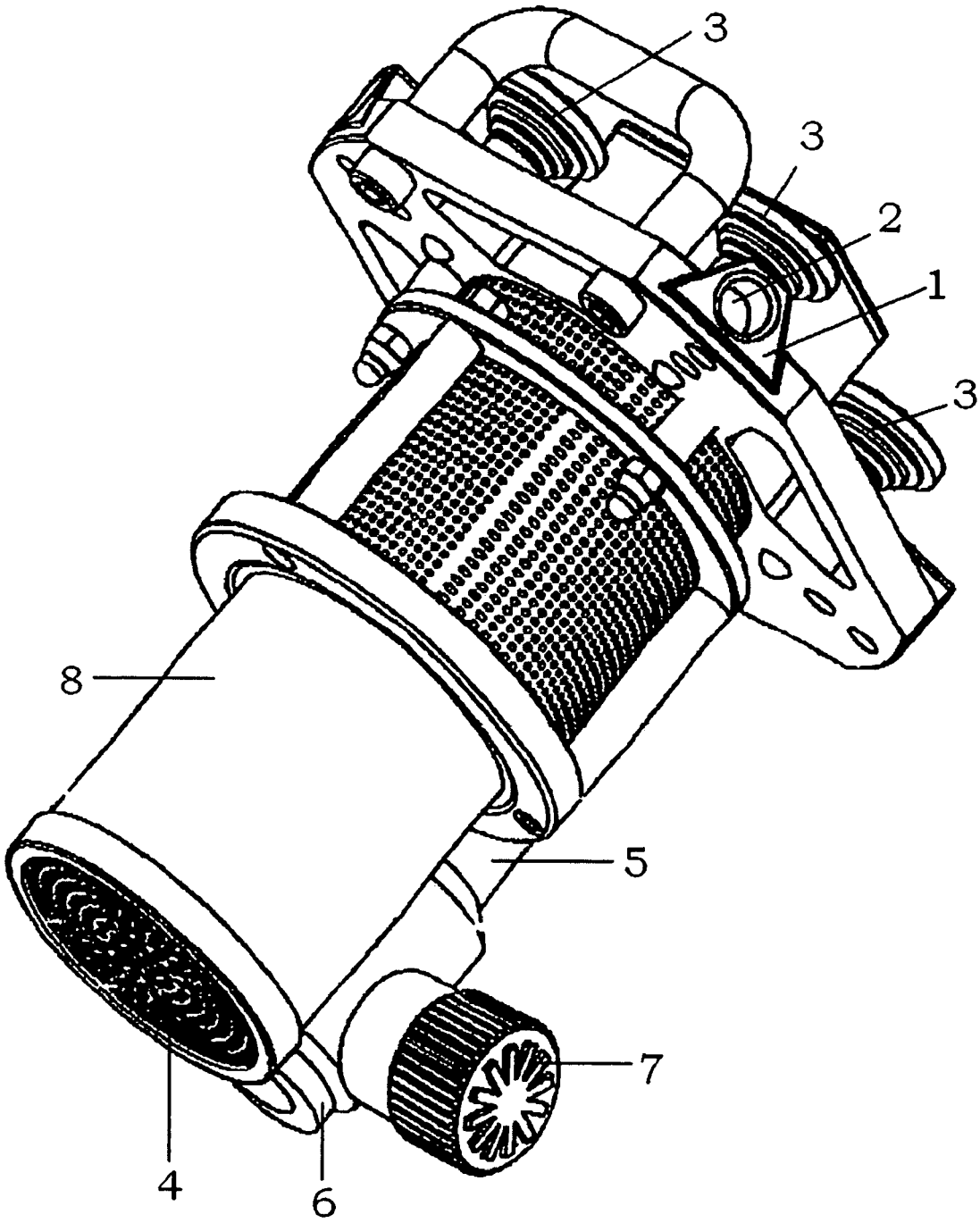
Figure 5:
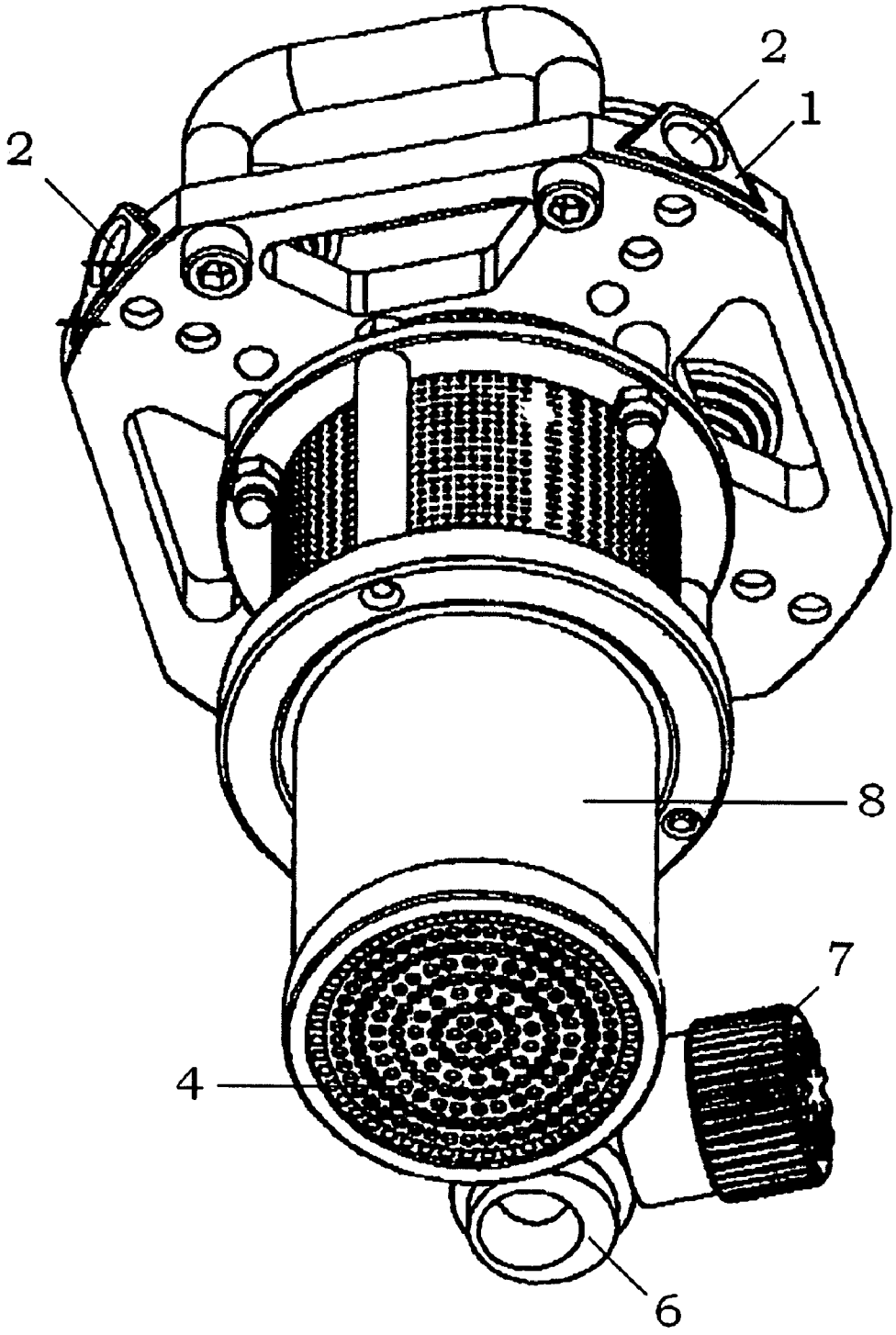
Figure 6:
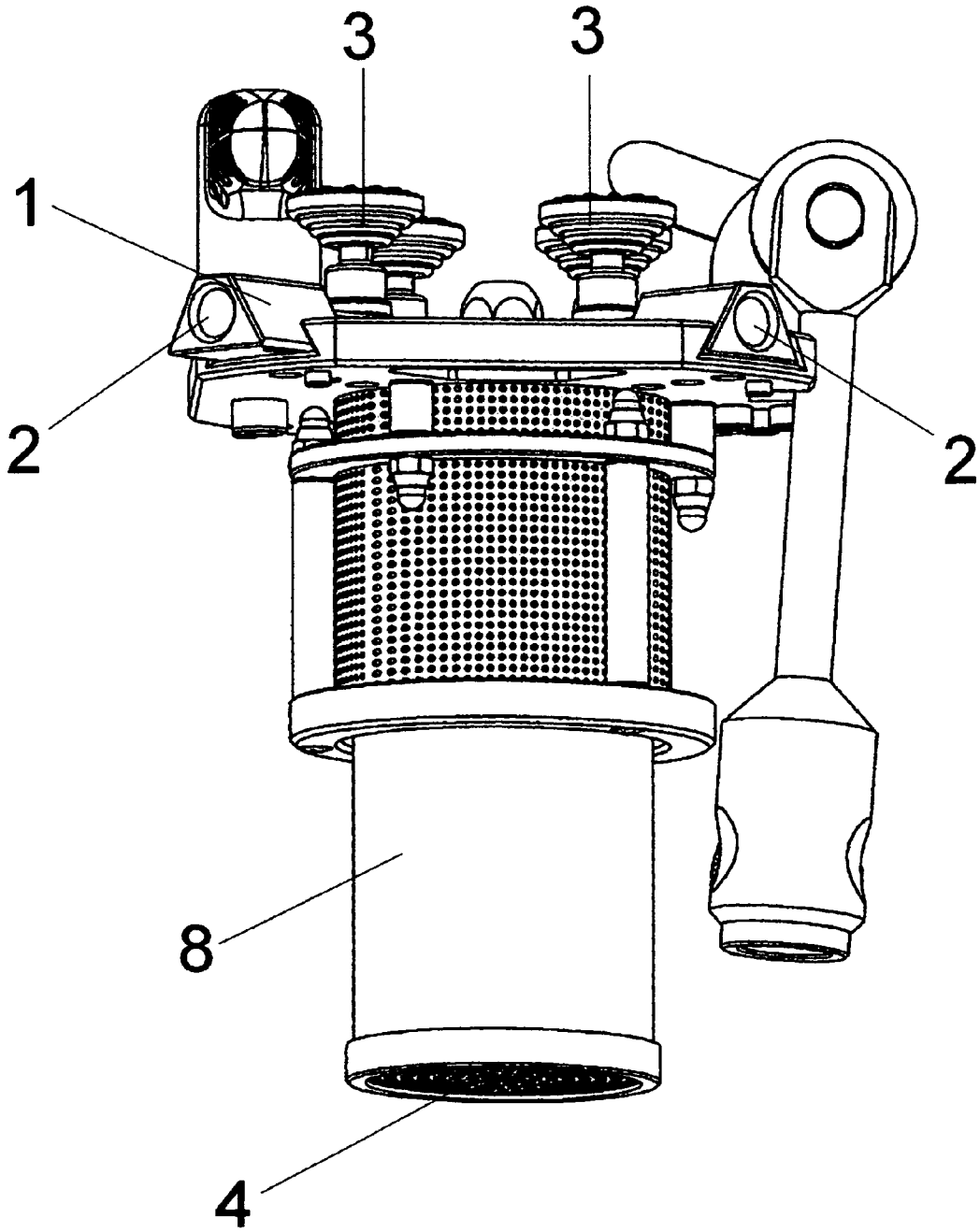
FIG. 6 shows the embodiment of FIGS. 1-5 in which the adjustable position of the locking device is shown on the left side and the locked position of the locking device is shown on the right side.
Figure 7:
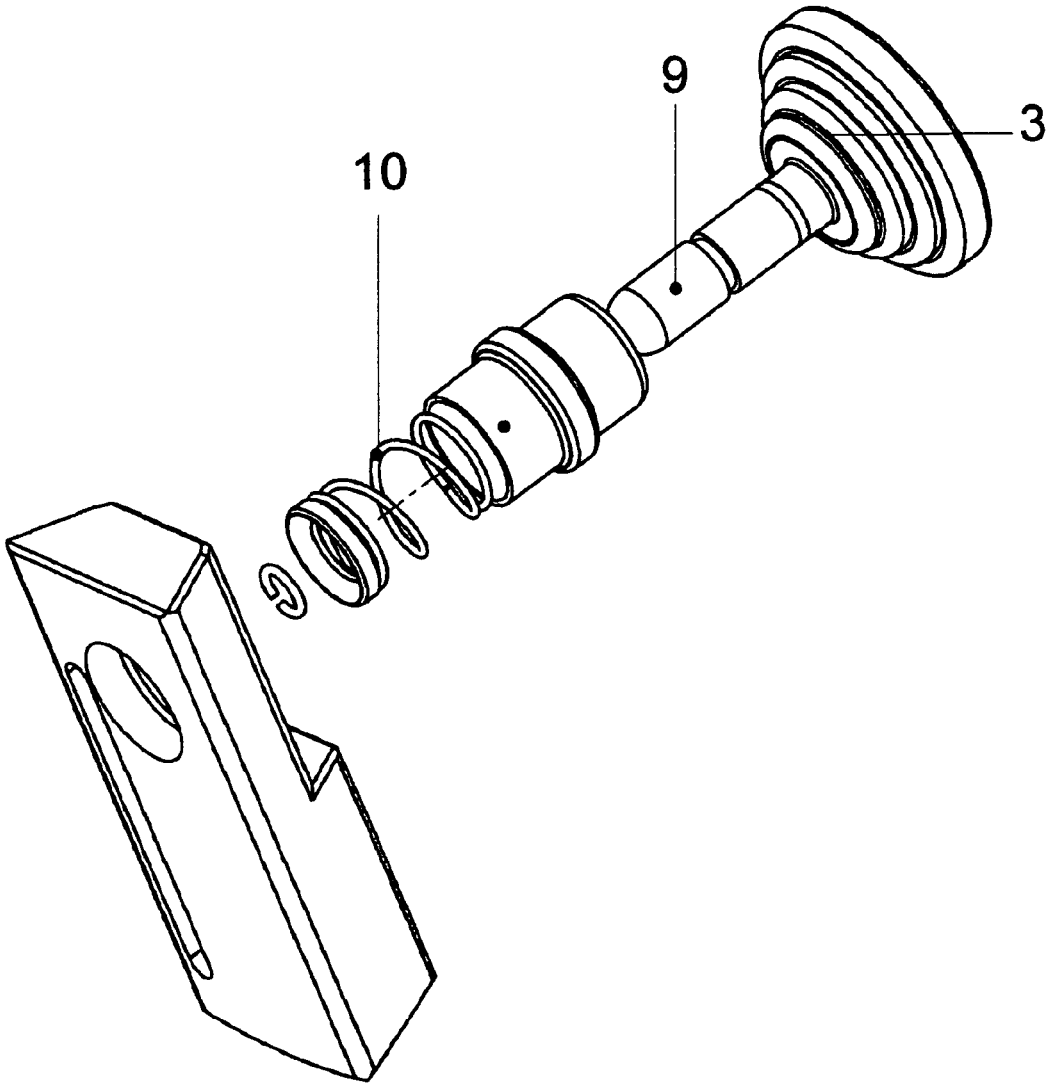
FIG. 7 is an exploded view of the locking device of the embodiment of FIGS. 1-5.
Figure 8:
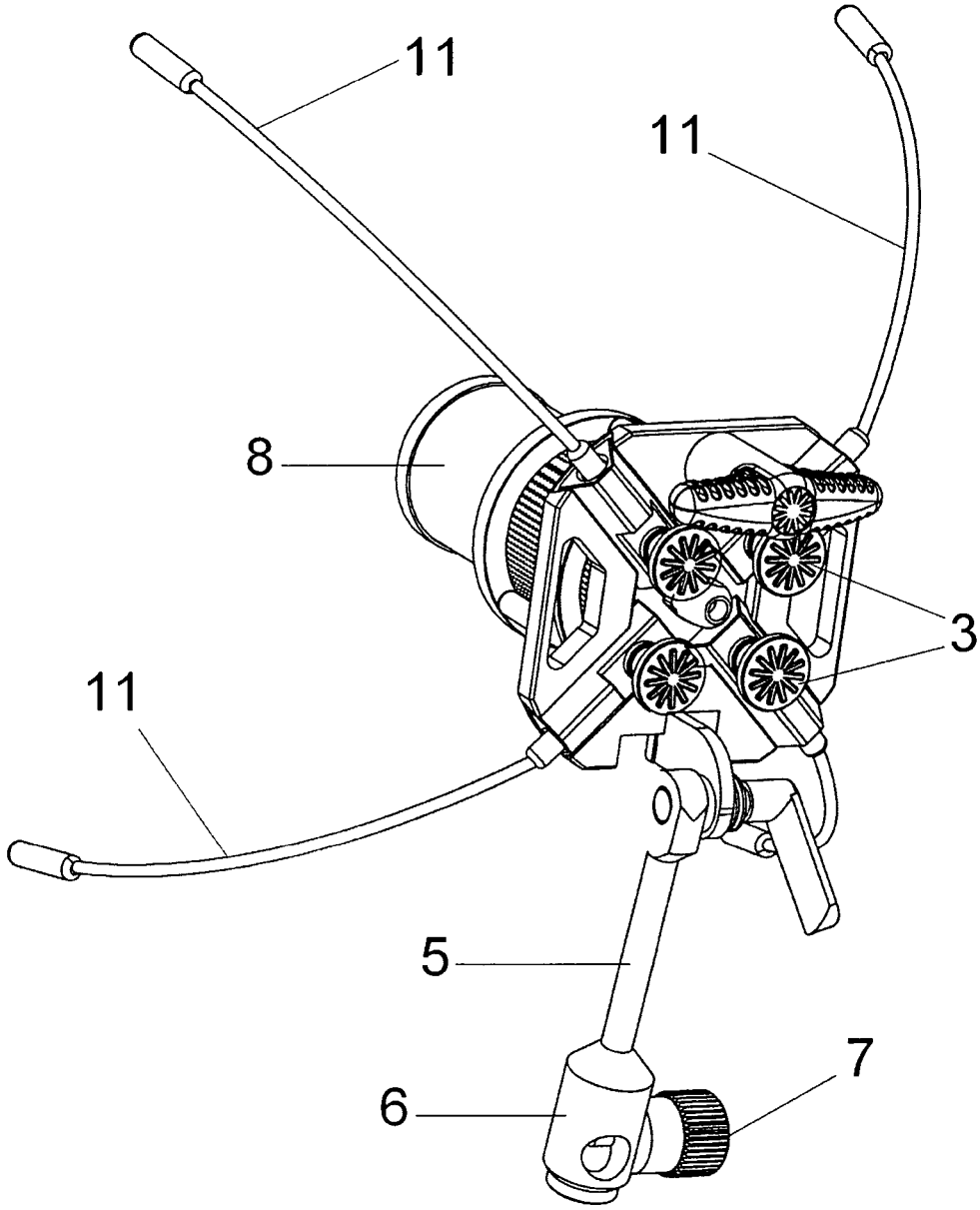
FIG. 8 shows an embodiment of the lighting unit according to the invention showing softbox rods inserted into the hollow cylinders but without the softbox shown itself.
Figure 9:
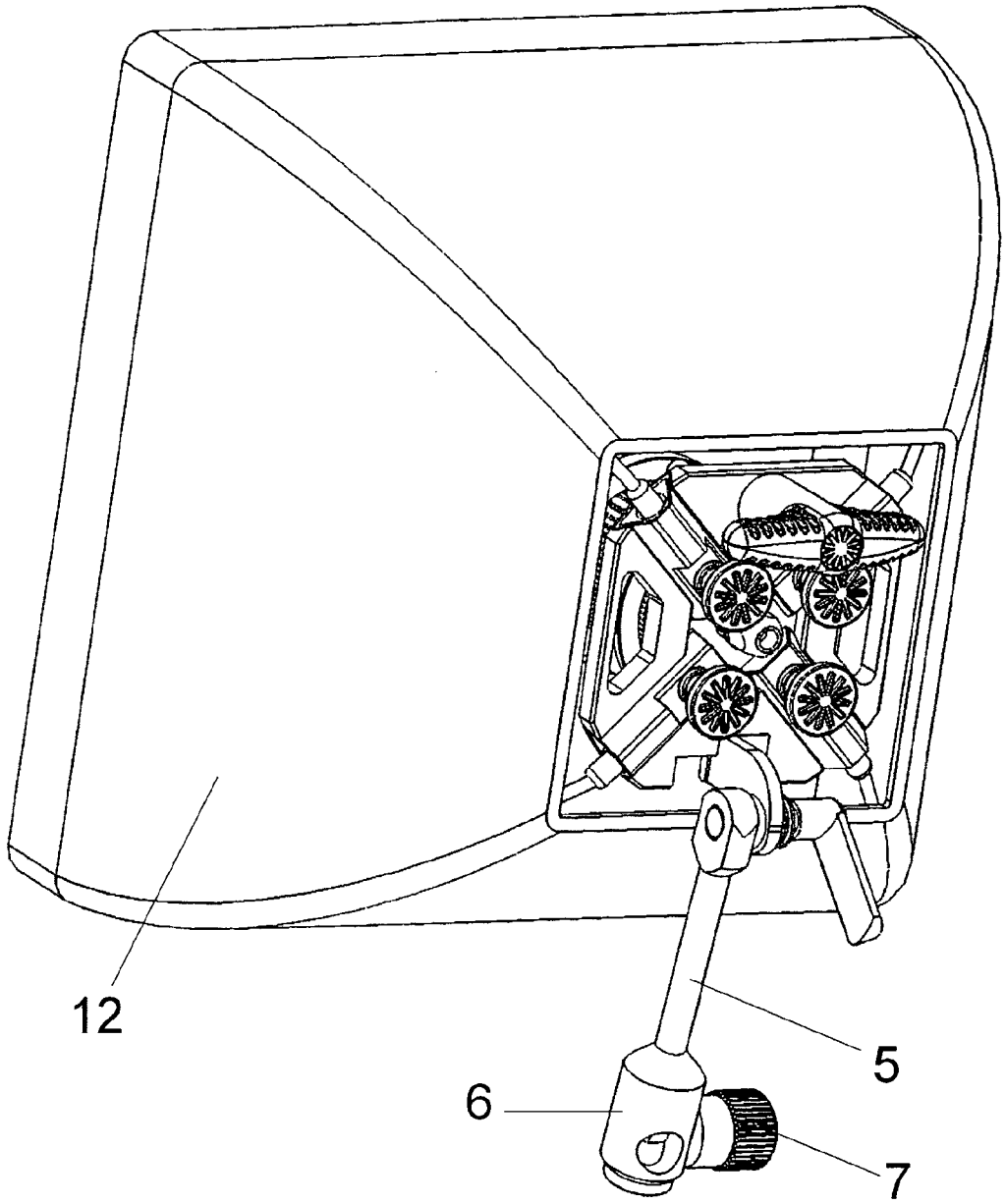
FIG. 9 shows the mebodiment of FIG. 8 with the softbox mounted onto the softbox rods.
Figure 10:
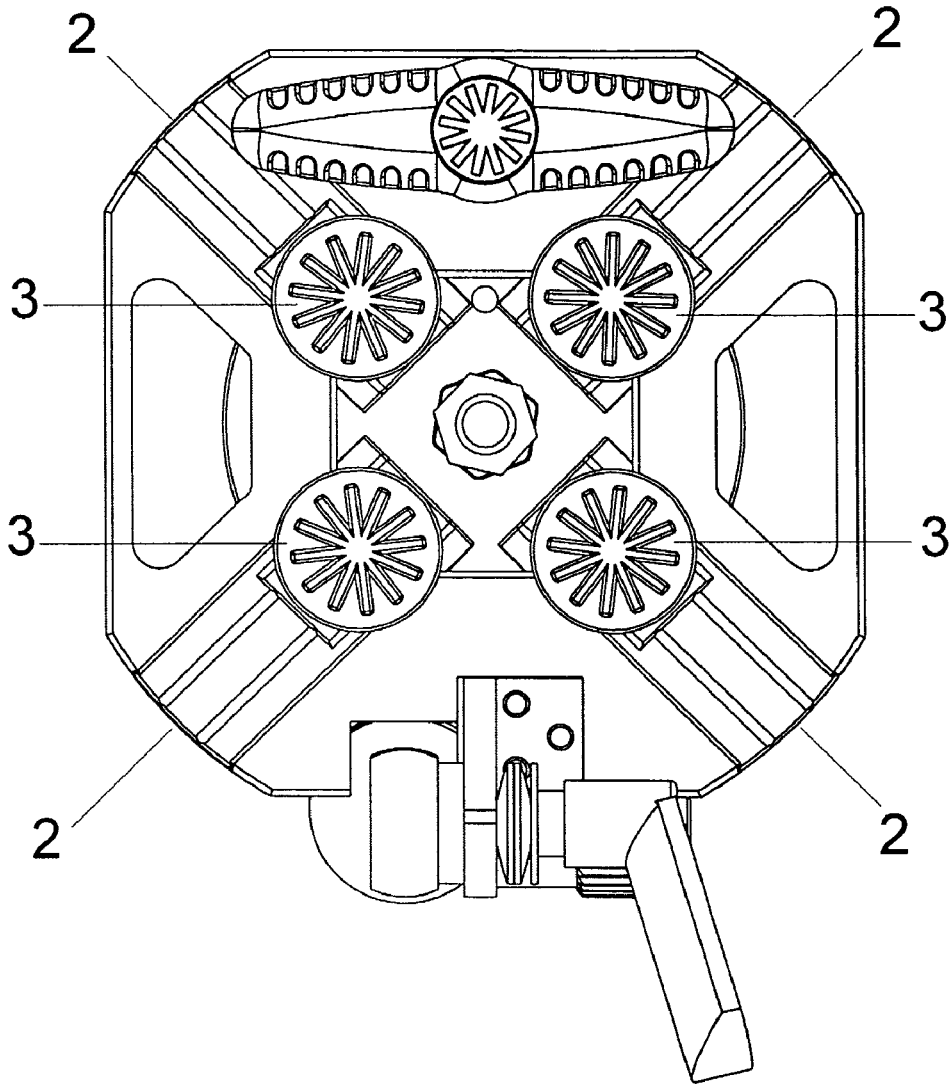
FIG. 10 is a rear end view of the embodiment of FIG. 8 without softbox rods and showing the hollow cylinders in the innermost position.
Figure 11:
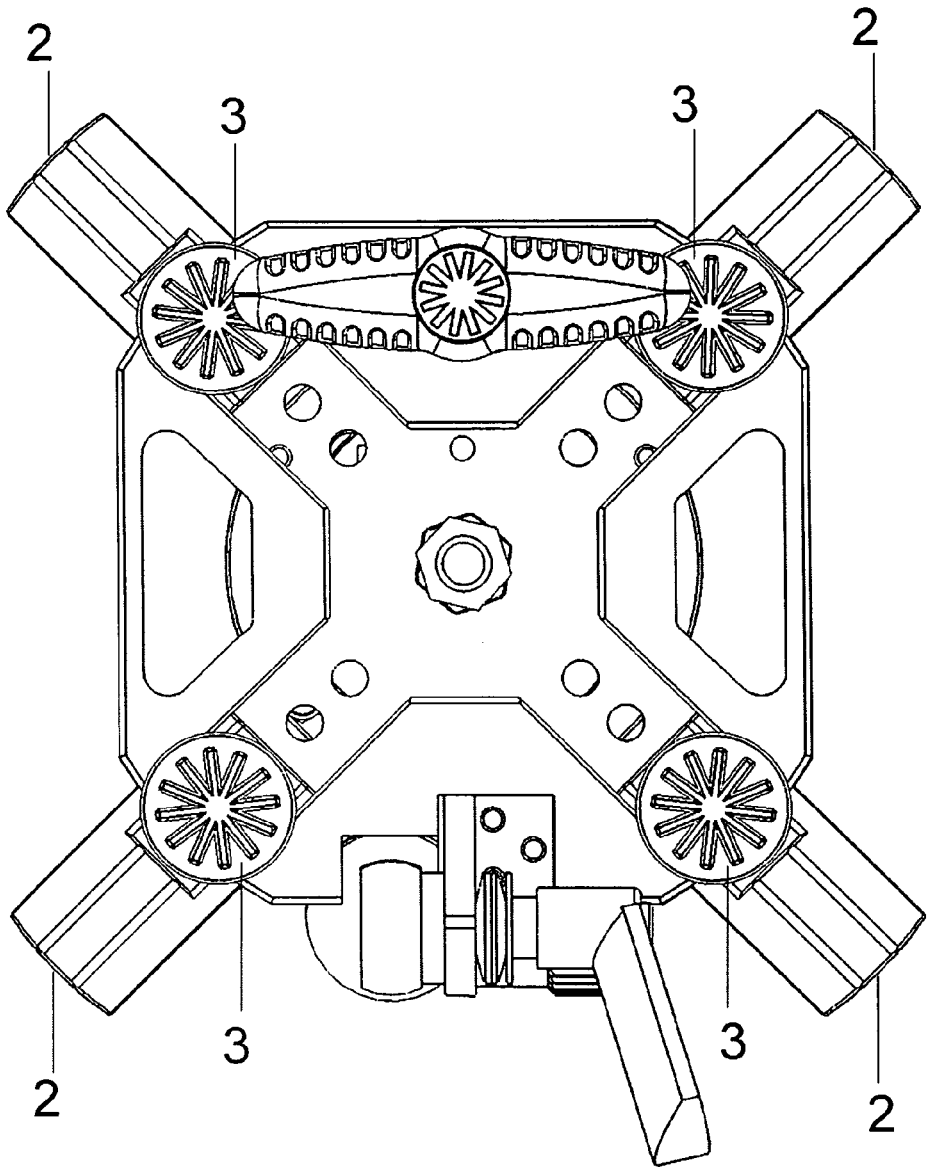
FIG. 11 is a rear end view corresponding to FIG. 10 showing the hollow cylinders in the outermost position.

FIGS. 1-5, which are described hereafter not individually, but as one unit, illustrate an embodiment of a lighting unit of the present invention in five different views. FIG. 6 shows the embodiment of FIGS. 1-5 in which the adjustable position of the locking device is shown on the left side and the locked position of the locking device is shown on the right side. FIG. 7 is an exploded view of the locking device of the embodiment of FIGS. 1-5. FIG. 8 shows the lighting unit with softbox rods 11 inserted into the hollow cylinders and FIG. 9 shows the softbox 12 mounted onto the softbox rods. FIG. 10 shows the hollow cylinders 2 in the innermost position and FIG. 11 shows the hollow cylinders 2 in the outermost position.

The embodiment of a lighting unit of the invention illustrated in the figures includes a housing 8. In the illustrated embodiment, the housing 8 is a tube-like quartz glass body, which at a front end 4 is provided with a protective grating held by an aluminum ring. Inside the tubular quartz glass body, a light source is arranged (not shown in the figures). The light emitted by the light source emerges through the front end 4 that is provided with a protective grating as well as through the cylindrical wall of the tubular quartz glass body 8.

At its end that is opposite the light-emitting front end 4 of the housing 8, the light unit has a device 1 for the attachment of a softbox 12. The device 1 for the attachment of the softbox 12 has four hollow spaces, each holding a hollow cylinder 2. Essentially, the four hollow cylinders 2 are equally spaced around the periphery of the lighting unit.

Each hollow cylinder 2 is slidable in the direction of its longitudinal axis and can be locked into position by a locking device.

In the instant embodiment, the locking device for each of the four hollow cylinders 2 includes a spring-loaded knob 3, which on its end that faces the respective hollow cylinder 2 is provided with a pin 9 having tension spring 10 (FIG. 7), which pin 9 can engage in holes in the shell of the hollow cylinder 2 (not shown in the figures) that are provided as receptacles for this pin. The four spring-loaded knobs 3 can be easily lifted by hand. When the knob 3 is in its lifted position, the corresponding hollow cylinder 2 is unlocked and can be moved outward in the direction of its longitudinal axis. All that is required to lock a hollow cylinder 2 into a certain position is to release the respective knob 3. Due to the corresponding tension spring, the knob 3 is pulled in the direction of the hollow cylinder 2, where it is adequately held in place.

FIG. 6 shows the locking device in adjustable position (knob 3 on the left side) as well as in locked position (knob 3 on right side). Knob 3 on the left side is pulled slightly higher than knob 3 on the right side. Accordingly, the hollow cylinder 2 on the left side may slide in the outward direction, as shown in FIG. 6, while the hollow cylinder 2 on the right side is arrested.

Each of the four cylinders 2 has four openings in its hollow cylindrical shell for the engagement of the corresponding pin of the locking device. Thus, each hollow cylinder 2 can be locked into four different positions. In the illustrated embodiment of the lighting unit of the present invention, all four hollow cylinders 2 are of identical construction.

In the illustrated embodiment of the lighting unit of the present invention, each hollow cylinder 2 is 130 mm long and can be adjusted in 20 mm increments by a maximum of 60 mm. Accordingly, in the instant embodiment of the lighting unit of the present invention, the minimum receptive length of a softbox rod 11 is 130 mm, and the maximum receptive length for a softbox rod 11 is 190 mm.

In the embodiment of the lighting unit of the present invention illustrated in the figures, the device 1 for the attachment of the softbox 12 further includes a rotatable tripod arm 5, which is rotatable in the area between a first end position and a second end position. In its first end position, the rotatable tripod arm 5 is essentially oriented in the direction of the front end 4 of the lighting unit and is basically positioned in parallel to the housing 8. In the figures, the tripod arm 5 is shown, in this, first end position. In the illustrated embodiment of the lighting unit of the present invention, the tripod arm 5 can be rotated by approximately 180 degrees to the rear from this first end position. This makes it possible to tilt the softbox 12 on a tripod without the necessity of a substantial overall increase in the packing size of the lighting unit.

In other embodiments of the lighting unit of this invention, the range of rotation of the rotatable tripod arm is smaller than 180 degrees, or even larger than 180 degrees.

For the purpose of mounting to a tripod rod, the tripod arm 5 is provided on its free end with a cross sleeve 6 such that it can be mounted to the tripod rod longitudinally as well as transversally. The cross sleeve 6 has a set screw 7, which is designed such that it can be used for locking into position in the longitudinal mounting direction as well as the transversal mounting direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lighting unit, comprising:

a housing; and a device for an attachment of a softbox, wherein the device for the attachment of the softbox is integrated in said housing and has at least three hollow cylinders residing in respective channel portions of the housing, each of the at least three hollow cylinders serving as receptacles of one softbox rod, respectively;

wherein each of the at least three hollow cylinders slides relative to the respective channel portion of the housing in a direction of a longitudinal axis of the respective hollow cylinder, said longitudinal axis being orthogonal to a main optical axis of the lighting unit and each of the at least three hollow cylinders acting in concert with a locking device to be manually set in a locked position and an adjustable position without additional tools, and wherein in the locked position, the locking device locks the hollow cylinder into at least one position, and in the adjustable position, the hollow cylinder slides in the direction of the respective longitudinal axis to a different position.

2. The lighting unit according to claim 1, wherein for at least one of the hollow cylinders, the locking device includes a pin having a knob and a tension spring.

3. The lighting unit according to claim 1, wherein all of the, hollow cylinders are constructed in the same way.

4. The lighting unit according to claim 1, wherein the hollow cylinders are essentially equally distributed around a circumference of the lighting unit.

5. The lighting unit according to claim 1, wherein the at least three hollow cylinders are four hollow cylinders.

6. The lighting unit according to claim 1, wherein the device for the attachment of the softbox is located at an end facing away from a light-emitting front end of the lighting unit.

7. The lighting unit according to claim 1, wherein the device for the attachment of the softbox includes a rotatable tripod arm rotatable in an area between a first end position and a second end position, wherein in the first end position, the rotatable tripod arm is essentially oriented in a direction of the light-emitting front end of the lighting unit and from the first end position rotatable by at least 90 degrees.

8. The lighting unit according to claim 7, wherein from the first end position, the rotatable tripod arm is rotatable by one of at least 100 degrees, at least 120 degrees, at least 140 degrees, at least 160 degrees, and at least 180 degrees.

9. The lighting unit according to claim 7, wherein at a free end of the rotatable tripod arm, the rotatable tripod arm is provided with a cross sleeve for mounting to a tripod rod longitudinally as well as transversally.

10. The lighting unit according to claim 9, wherein the cross sleeve is provided with a set screw for locking into position both in a longitudinal insertion direction and in a transversal insertion direction.

* * * * *